US011465010B2

(12) United States Patent
Ho

(10) Patent No.: US 11,465,010 B2
(45) Date of Patent: Oct. 11, 2022

(54) FOLDABLE EXERCISE BENCH

(71) Applicant: Willy Wei Yu Ho, Boyton Beach, FL (US)

(72) Inventor: Willy Wei Yu Ho, Boyton Beach, FL (US)

( * ) Notice: Subject to any disclaimer, the term of this patent is extended or adjusted under 35 U.S.C. 154(b) by 0 days.

(21) Appl. No.: 17/145,553

(22) Filed: Jan. 11, 2021

(65) Prior Publication Data

US 2022/0219037 A1 Jul. 14, 2022

(51) Int. Cl.
*A63B 21/00* (2006.01)
*A63B 21/078* (2006.01)

(52) U.S. Cl.
CPC ..... *A63B 21/4029* (2015.10); *A63B 21/078* (2013.01); *A63B 2208/0228* (2013.01); *A63B 2210/50* (2013.01); *A63B 2225/09* (2013.01)

(58) Field of Classification Search
CPC . A63B 21/4029; A63B 23/00; A63B 23/0211; A63B 2071/025; A63B 2225/09; A63B 2210/50; A63B 21/078
See application file for complete search history.

(56) References Cited

U.S. PATENT DOCUMENTS

| | | | | |
|---|---|---|---|---|
| D933,762 | S * | 10/2021 | Wang | D21/687 |
| 2003/0134730 | A1* | 7/2003 | Deola | A63B 23/00 482/130 |
| 2005/0197238 | A1* | 9/2005 | Parker | A63B 21/4029 482/142 |
| 2006/0035772 | A1* | 2/2006 | Golesh | A63B 21/4031 482/142 |
| 2006/0122045 | A1* | 6/2006 | Webber | A63B 21/4029 482/142 |
| 2019/0151699 | A1* | 5/2019 | Isom | A63B 21/00047 |

OTHER PUBLICATIONS https://www.amazon.com/dp/B07MNPRJFK/ref=sspa_dk_detail_2?psc=1&pd_rd_i=B07MNPRJFK&pd_rd_w=JJhkA&pf_rd_p=54ed5474-54a8-4c7f-a88a-45f748d18166&pd_rd_wg=dZgo4&pf_rd_r=QG840XKWT62BCBFE0T2V&pd_rd_r=c32ea9d8-b10c-426f-8c92-2e551e75d7a5&spLa=ZW5jcnlwdGVkUXVhbGlmaWVyPUExMTRXRzBHT0QzT0MxJmVuY3J5cHRIZElkPUEwNz (Year: 2018).* https://www.amazon.com/dp/B07S7NRZL4/ref=sspa_dk_detail_4?psc=1&pd_rd_i=B07S7NRZL4&pd_rd_w=JA7FN&pf_rd_p=9fd3ea7c-b77c-42ac-b43b-c872d3f37c38&pd_rd_wg=URyg8&pf_rd_r=G5KVX49SZD869RG6NP96&pd_rd_r=7bfa9a10-9096-447a-8359-905a27a1e821&spLa=ZW5jcnlwdGVkUXVhbGlmaWVyPUExUjlTRE8zMIA5OU5WJmVuY3J5cHRIZElkPUEwND (Year: 2019).* https://www.amazon.com/dp/B08H59NMYY/ref=sspa_dk_detail_4?psc=1&pd_rd_w=4MZ5Q&pf_rd_p=9fd3ea7c-b77c-42ac-b43b-c872d3f37c38&pd_rd_wg=Fmghv&pf_rd_r=WSXDZXMHRCNBKWKD78ZR&pd_rd_r=c506d040-9fef-4bad-94ab-1651a51d6e62&spLa=ZW5jcnlwdGVkUXVhbGlmaWVyPUFQVzFZNzhJWlo4NkkmZW5jcnlwdGVkSWQ9QTA4MjYzMjAyS1cyMIJCRU1VN (Year: 2020).*

* cited by examiner

*Primary Examiner* — Andrew S Lo
*Assistant Examiner* — Andrew M Kobylarz
(74) *Attorney, Agent, or Firm* — Womble Bond Dickinson (US) LLP

(57) ABSTRACT

Embodiments are disclosed of an exercise bench. The exercise bench includes a girder coupled to a seat, the girder including a front end and a rear end. A first fitting is coupled to the front end and a second fitting is coupled to the rear end. A front leg is rotatably coupled to the first fitting so that the front leg can rotate about the first fitting between a deployed position and a stored position, and a rear leg is rotatably coupled to the second fitting so that the rear leg can rotate about the second fitting between a deployed position and a stored position. A pair of backrest rails are coupled to a backrest and rotatably coupled to the second fitting, and an angular adjustment mechanism can be used to adjust the angle of the backrest relative to the seat.

21 Claims, 11 Drawing Sheets

FOLDABLE EXERCISE BENCH

TECHNICAL FIELD

The disclosed embodiments relate generally to exercise equipment and in particular, but not exclusively, to a foldable exercise bench.

BACKGROUND

Many exercise activities require specialized equipment that can be quite bulky and, currently, much exercise equipment is not easily collapsed for storage. Most exercise equipment is also not attractive as a piece of furniture and not useful for much other than its intended function. Before buying current exercise equipment, then, a buyer must have a dedicated space for using and storing the exercise equipment. But this is often not feasible, especially for people who live in small houses or apartments. One alternative is to join a fitness club and use its exercise equipment, but that can be expensive and people often don't want the multi-year commitment fitness clubs can entail.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 1A is an exploded perspective view; FIG. 1B is an assembled perspective view; FIGS. 1C-1D are top and bottom plan views, respectively; and FIGS. 1E-1F are side and front views, respectively.

FIG. 2A is a perspective view, FIG. 2B a side view.

FIG. 3A is a perspective view, FIG. 3B a side view.

FIG. 5A is a perspective view during folding of the rear leg; FIGS. 5B-5C are perspective views of the folded configuration; and FIG. 5D is a side view of the folded configuration.

DETAILED DESCRIPTION

Figure 1A:
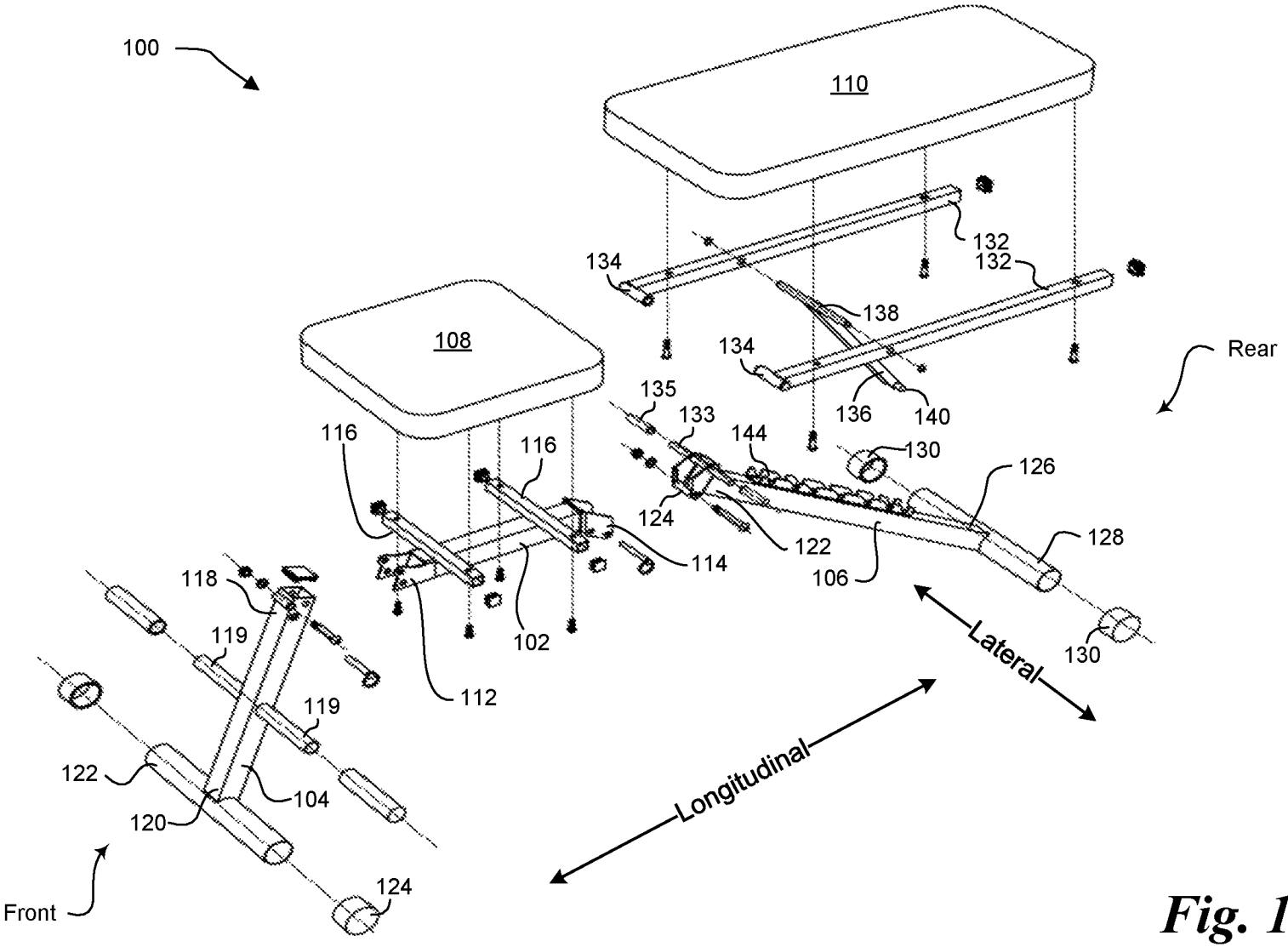
FIGS. 1A-1F are drawings of an embodiment of a foldable exercise bench in a deployed configuration.

Embodiments are described of a foldable exercise bench. Specific details are described to provide an understanding of the embodiments, but one skilled in the relevant art will recognize that the invention can be practiced without one or more of the described details or with other methods, components, materials, etc. In some instances, well-known structures, materials, or operations are not shown or described in detail but are nonetheless encompassed within the scope of the invention.

Reference throughout this specification to "one embodiment" or "an embodiment" means that a described feature, structure, or characteristic can be included in at least one described embodiment, so that appearances of "in one embodiment" or "in an embodiment" do not necessarily all refer to the same embodiment. As used in this application, directional terms such as "front," "rear," "top," "bottom," "side," "lateral," "longitudinal," etc., refer to the orientations of embodiments as they are presented in the drawings, but any directional terms should not be interpreted to imply or require any particular orientation of the described embodiments when in actual use. Furthermore, the particular features, structures, or characteristics may be combined in any suitable manner in one or more embodiments.

Figure 1B:
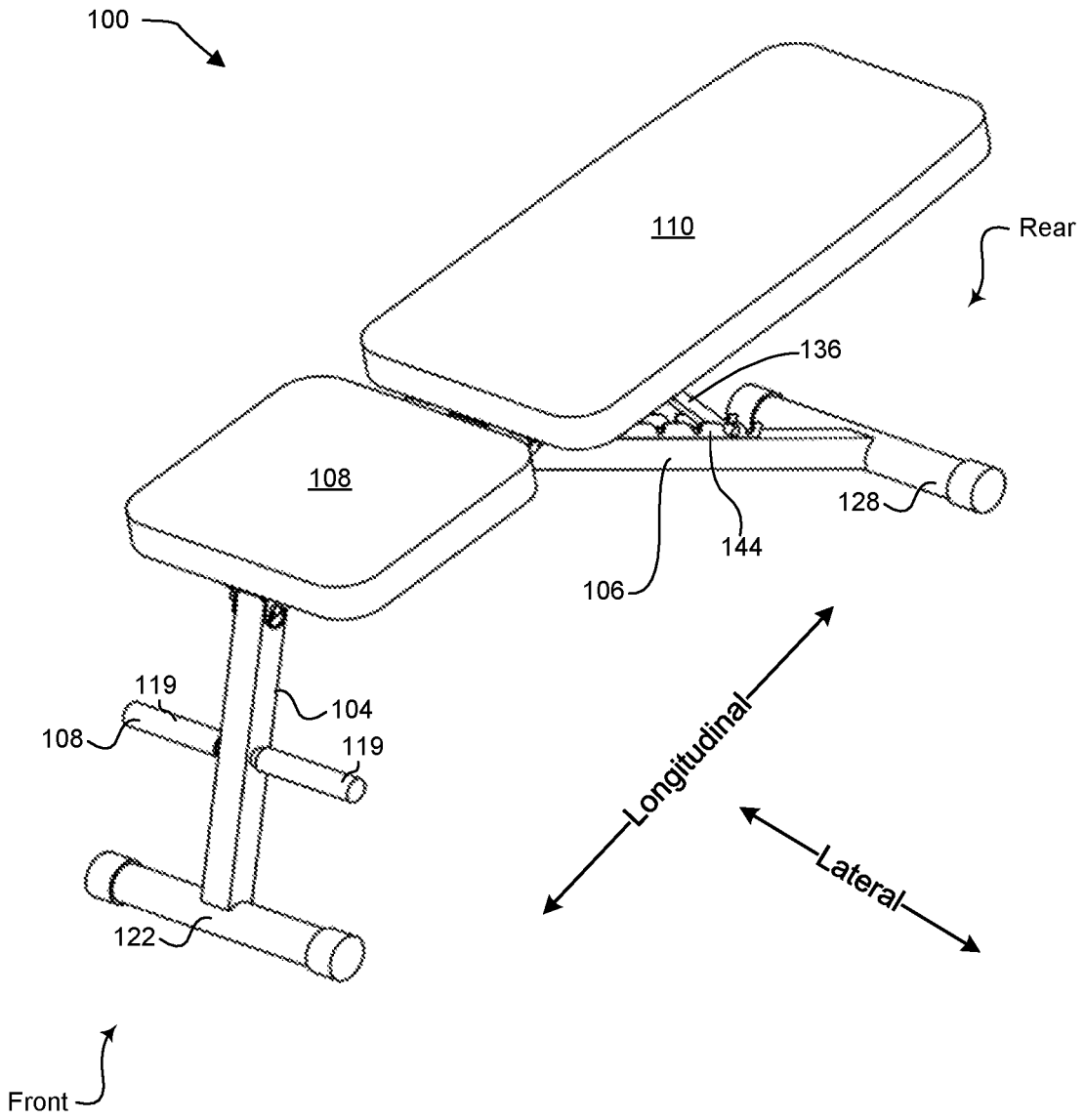
Figure 1C:
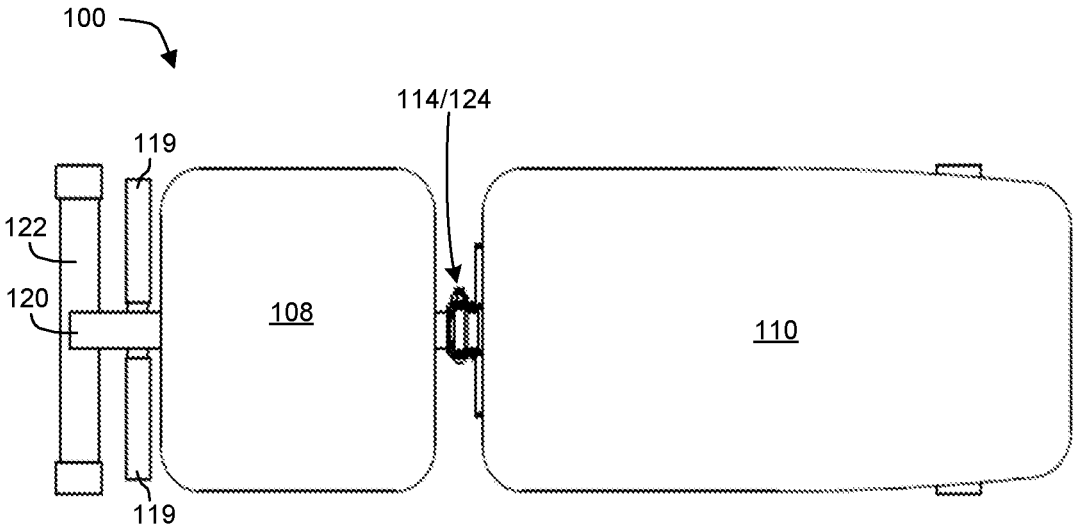
Figure 1D:
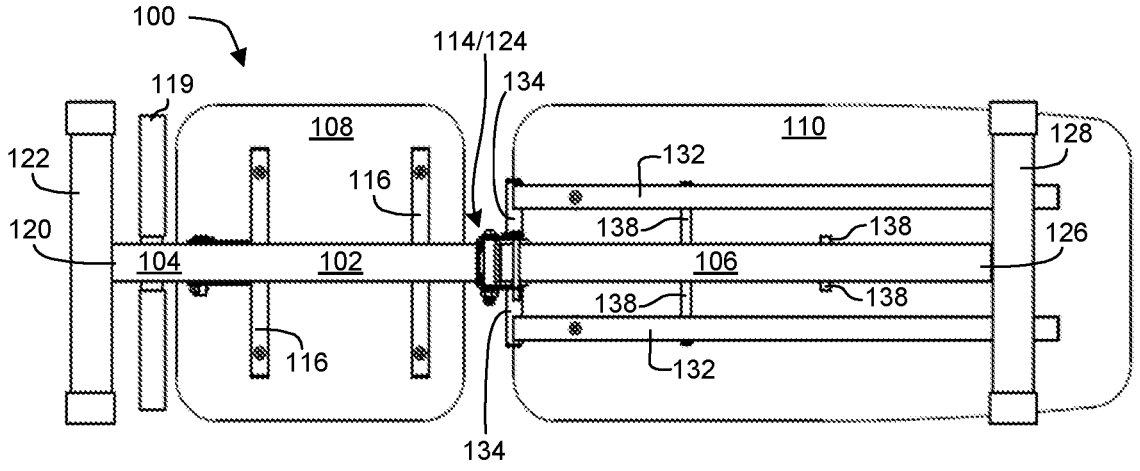
Figure 1E:
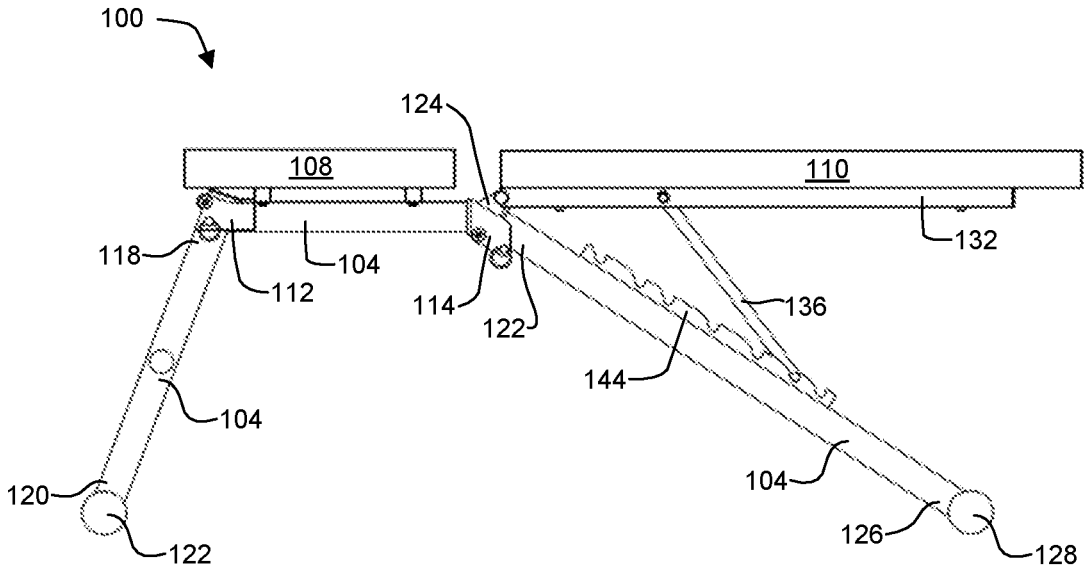
Figure 1F:
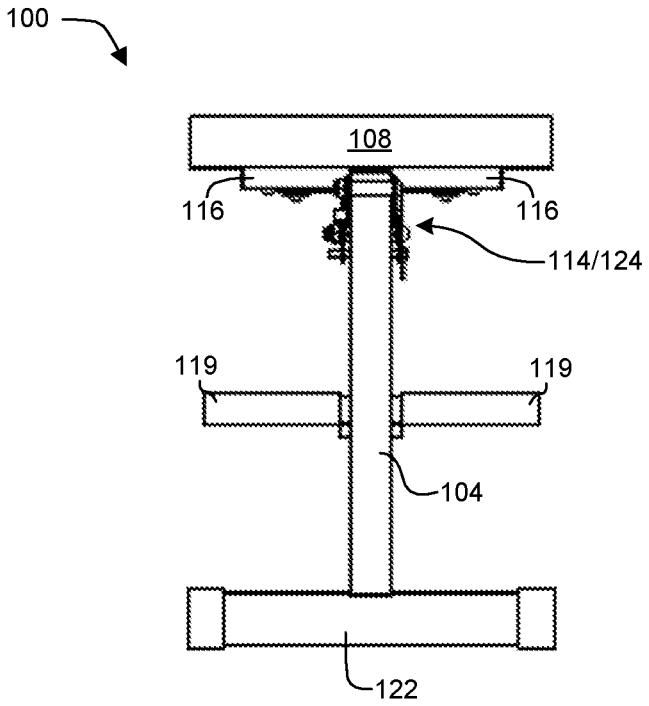

FIGS. 1A-1F together illustrate an embodiment of a foldable exercise bench 100. FIG. 1A is an exploded perspective view; FIG. 1B is an assembled perspective view; FIGS. 1C-1D are top and bottom plan views, respectively; and FIGS. 1E-1F are side and front views, respectively.

Foldable exercise bench 100 has a frame that includes a girder 102, a front leg 104, and a rear leg 106. A seat 108 is positioned on girder 102 and a back rest 110 with a variable angle relative to girder 102 is attached to a rear end of the girder. In the illustrated embodiment, girder 102, front leg 104, and rear leg 106 are hollow members with a quadrilateral cross-sectional shape, but in other embodiments the girder, front leg, and rear leg can have other cross-sectional shapes and need not be hollow. In still other embodiments, the girder, front leg, and rear leg need not have the same build or cross-sectional shape.

Girder 102 has a first fitting 112 attached to its front end and a second fitting 114 attached to its rear end. A pair of substantially parallel spaced-apart rails 116 are mounted to girder 102, and a seat 108 is then mounted to the rails. In other embodiments, seat 108 can be coupled to girder 102 differently than shown; for instance, seat 108 can be coupled to girder 102 with a structure different than rails 116, or can be directly mounted onto girder 102 without any intervening structure. First fitting 112 and second fitting 114 are further described below in connection with FIGS. 2A-2B and 3A-3B.

Front leg 104 has a proximal end 118 and a distal end 120. Distal end 120 has a foot 122 that extends perpendicular to front leg 104 and to either side of front leg 104. When exercise bench 100 is deployed, foot 122 stabilizes the bench and prevents it from tipping laterally. In the illustrated embodiment foot 122 is hollow and has a circular cross-sectional shape, but in other embodiments it need not be hollow and can have a different cross-sectional shape than shown. End caps 124 can be positioned on the ends of foot 122 both for aesthetic reasons and, if the end caps 124 are made of a material such as rubber, to keep bench 100 from sliding laterally or longitudinally across the floor when in use. Front leg 104 is coupled to girder 102 by inserting proximal end 118 into fitting 112 and inserting the required pins and bolts, as described below in connection with FIGS. 2A-2B. Front leg 104 can also include foot rests 119 on which a user sitting on seat 108 can rest their feet or hook their ankles when using the exercise bench.

Rear leg 106 includes a proximal end 122 and a distal end 126. As with front leg 104, distal end 126 has a foot 128 that extends perpendicular to rear leg 106 and to either side of the rear leg. When exercise bench 100 is deployed, foot 128, acting together with foot 122, stabilizes the bench and prevents it from tipping laterally. In the illustrated embodiment foot 128 is hollow and has a circular cross-sectional shape, but in other embodiments it need not be hollow and can have a different cross-sectional shape. End caps 130 can be positioned on the ends of foot 128 both for aesthetic reasons and, if end caps 130 are made of a material such as rubber, to keep bench 100 from sliding laterally or longitudinally during use.

A fitting 124 is positioned on proximal and 122 of leg 106. Rear leg 106 is coupled to girder 102 by coupling fitting 124 to fitting 114, as further described below in connection with FIGS. 2A-2B. Rear leg 106 also includes a pair of rails 144 positioned on an upper side thereof. Each pair of rails 144 includes aligned pairs of notches that define detents for adjusting the angular position of backrest 110.

Backrest 110 is coupled to a pair of substantially parallel spaced-apart rails 132 attached to its back side. Each rail 132 includes a cylindrical sleeve 134 at one of its ends, with each cylindrical sleeve being substantially perpendicular to an axis of its corresponding rail. Backrest 110 is coupled to girder 102 and rear leg 106 by coupling circular sleeves 134 to fitting 124 using rod 133 and bushings 135. To allow adjustment of the backrest angle (i.e., the angle of backrest 110 relative to seat 108 and/or girder 102), circular sleeves 134 are rotatably attached to fitting 124—i.e., circular sleeves 134 are attached to fitting 124 so that backrest 110 can rotate about rod 133, thus allowing the angle of backrest 110 relative to seat 108 to be adjusted. A positioning strut 136 includes a transverse portion 138 that is rotatably coupled to both rails 132 and also includes a transverse portion 140 that can be inserted into the detents formed by the notch pairs in rails 144. Thus, backrest 110 can rotate about fitting 124, and it is held at a desired angle by inserting transverse member 140 into the appropriate pair of detents in rails 144.

Figure 2A:
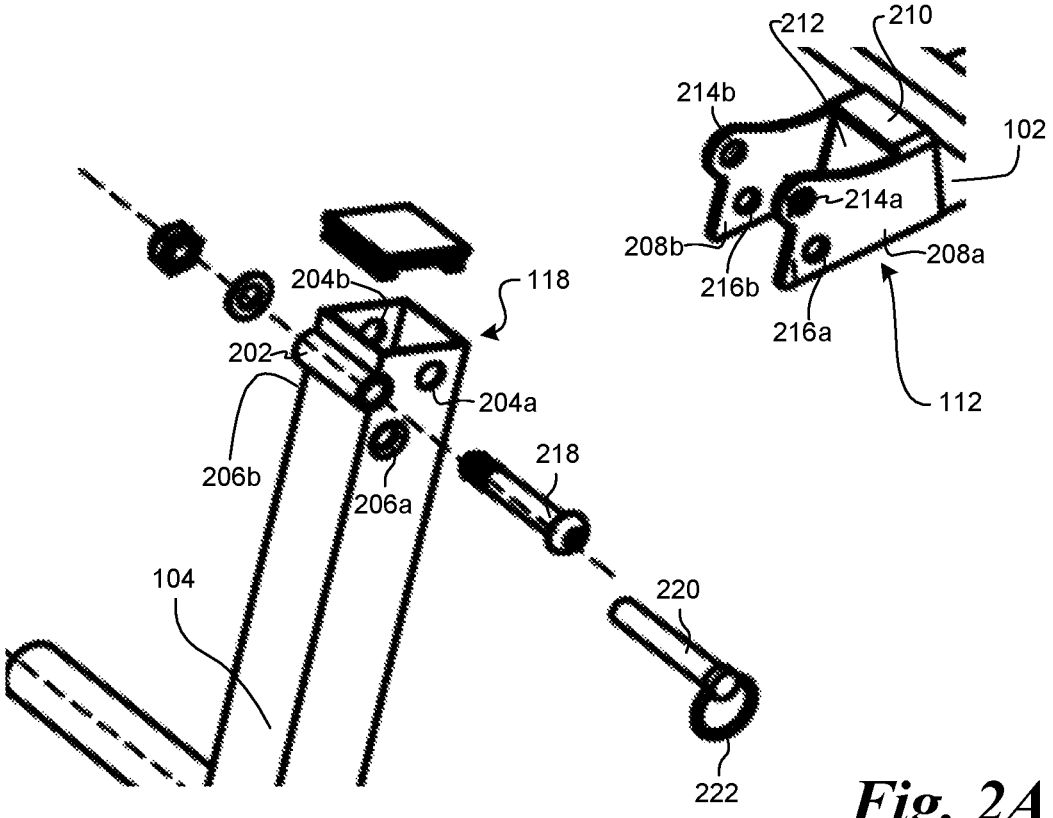
FIGS. 2A-2B are drawings of an embodiment of a fitting for coupling the girder to the front leg.
Figure 2B:
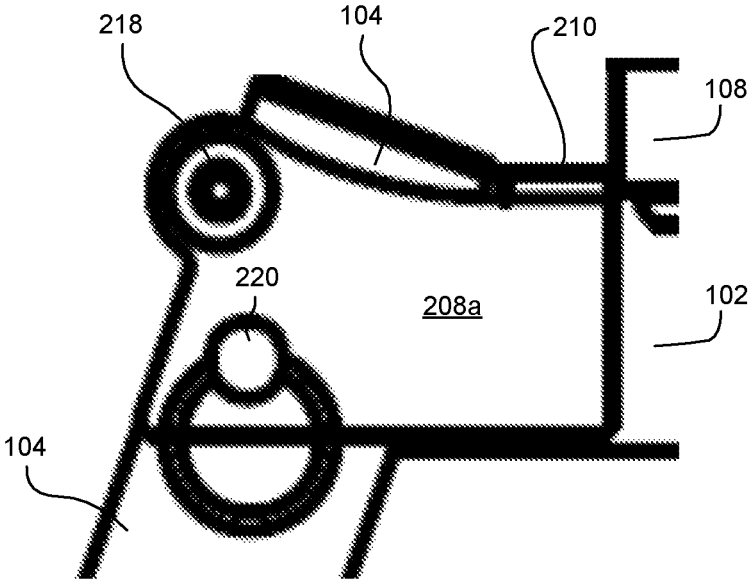

FIGS. 2A-2B together illustrate an embodiment of first fitting 112 for coupling front leg 104 to girder 102. FIG. 2A is a perspective view, FIG. 2B a side view. Front leg 104 includes a cylindrical sleeve 202 attached to a surface of the front leg, as well as two aligned hole pairs 204 and 206. Each hole pair 204 and 206 includes two aligned holes (i.e., two holes through which a faster or other straight member can be inserted) positioned in opposite sides of leg 104: hole pair 204 includes hole 204*a* in one side of leg 104 and aligned hole 204*b* in the opposite side of leg 104, and hole pair 206 includes hole 206*a* in the same side of leg 104 as hole 204*a* and an aligned hole 206*b* in leg 104 directly opposite hole 206*a*. Hole 206*b* in not visible in the view of FIG. 2A.

Fitting 112 includes a pair of laterally spaced-apart flanges 208*a* and 208*b*, both of which are coupled to a base 210 that is in turn coupled to the front end of girder 102. Base 210 includes a flat surface 212 that will be flush against one side of front leg 104 when the front leg is in its deployed position. The lateral spacing between flanges 208*a* and 208*b* is large enough to accommodate a dimension of front leg 104, in this case its lateral width. Flanges 208 includes two aligned hole pairs 214 and 216: aligned hole pair 214 includes hole 214*a* in flange 208*a* and hole 214*b* in flange 208*b*, while aligned hole pair 216 includes hole 216*a* in flange 208*a* and hole 216*b* in flange 208*b*.

To connect front leg 104 to girder 102, its proximal end 118 is inserted into fitting 112 between flanges 208*a* and 208*b* so that sleeve 202 aligns with hole pair 214. A bolt 218 is inserted into hole 214*a*, through sleeve 202, and out hole 214*b*, where a nut is attached to the end of the bolt and tightened to keep the bolt in place. Once bolt 218 is secured in place, front leg 104 can rotate about the bolt between a deployed position and a stored position. In the deployed position, a side of front leg 104 is brought flush with surface 212, at which point hole pair 206 in front leg 104 aligns with hole pair 216 in flanges 208. A pin 220 can then be inserted through holes 216*a*, 206*a*, 206*b*, and 216*b* to prevent rotation of front leg 104 about bolt 218, thus locking the front leg in its deployed configuration (see, e.g., FIGS. 1B-1F). Hole pair 206, including holes 206*a* and 206*b*, can thus be considered a "deployment hole," since the hole pair is used to lock front leg 104 is its deployed position. To change exercise bench 100 from its deployed position to its stored or folded configuration, front leg 104 is rotated about bolt 218 until hole pair 204 of the front leg aligns with hole pair 216 of the flanges, at which point the front leg will be in its stored position. Pin 220 can then be inserted through holes 216*a*, 204*a*, 204*b*, and 216*b* to prevent rotation of front leg 104 about bolt 218, thus locking the front leg in its stored or folded position (see, e.g., FIGS. 6A-6C). Hole pair 204, including holes 204*a* and 204*b*, can thus be considered a "storage hole," since the hole pair is used to lock front leg 104 is its stored position.

Figure 3A:
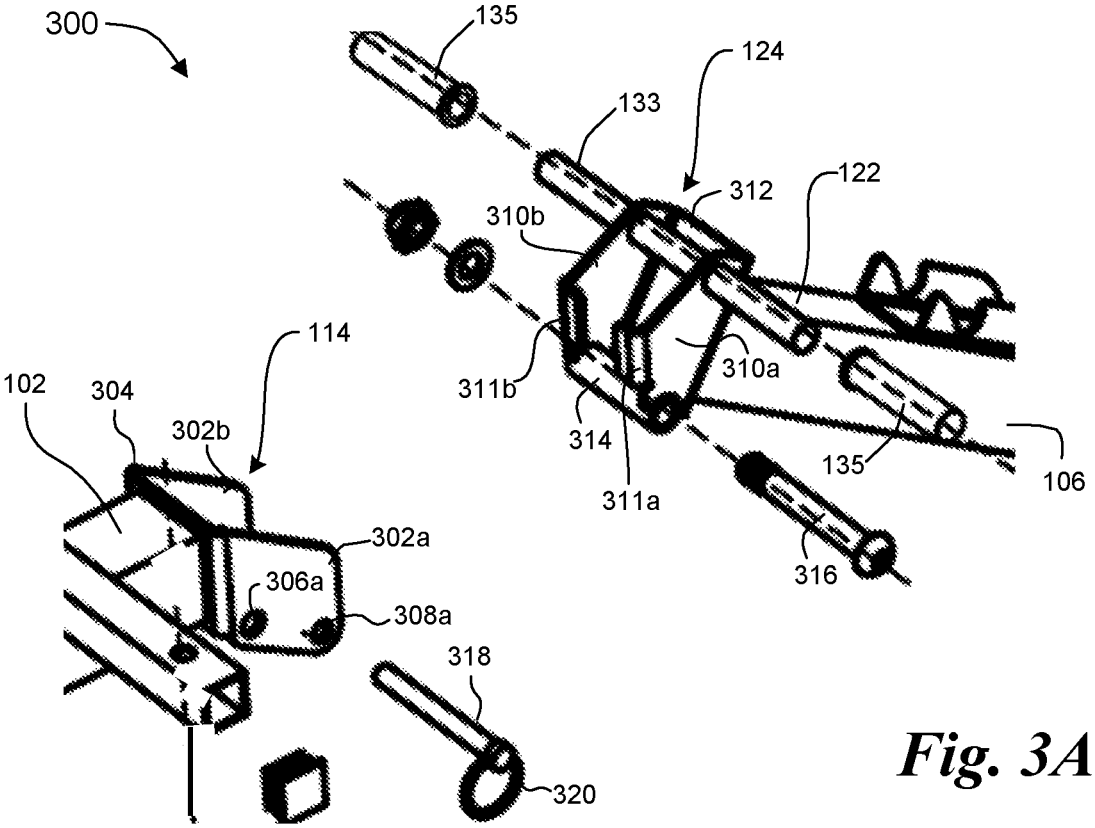
FIGS. 3A-3B are drawings of an embodiment of a fitting for coupling the girder to the rear leg.
Figure 3B:
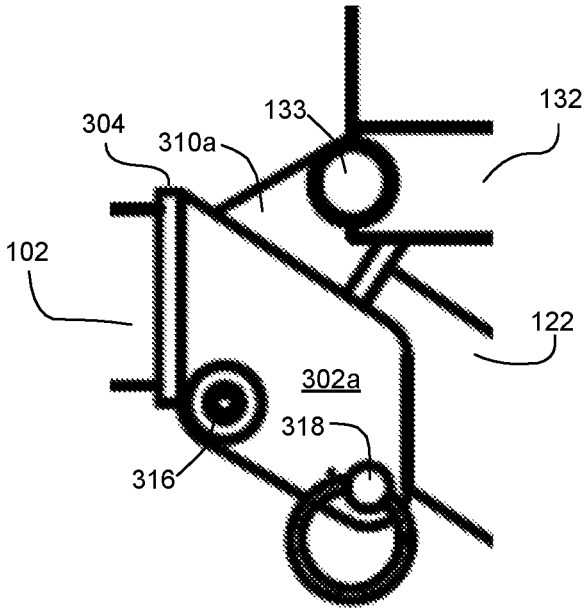

FIGS. 3A-3B together illustrate an embodiment of a fitting 300 for coupling girder 102 to rear leg 106. FIG. 3A is a perspective view, FIG. 3B a side view. Fitting 300 includes two parts: a fitting 114 coupled to the rear end of girder 102, and another fitting 124 coupled to the proximal end of rear leg 106.

Fitting 114 includes a pair of laterally spaced-apart flanges 302*a* and 302*b*, both of which are coupled to base 304. Base 304 is in turn coupled to the rear end of girder 102. The lateral spacing between flanges 302*a* and 302*b* is sized to accommodate a dimension of fitting 124, in this case its lateral width. Flanges 302 includes two aligned hole pairs 306 and 308—that is, each flange 302 includes a pair of holes, and each hole in each flange has a corresponding aligned hole in the other flange. Thus, aligned hole pair 306 includes hole 306*a* in flange 302*a* and hole 306*b* in flange 302*b*, and aligned hole pair 308 includes hole 308*a* in flange 302*a* and hole 308*b* in flange 302*b*. Holes 306*b* and 308*b* are not visible in the figure.

Fitting 124 is coupled to a proximal end 122 of rear leg 106. This fitting includes a pair of laterally spaced-apart flanges 310*a* and 310*b* coupled to a base 312. In the illustrated embodiment flanges 310*a*-310*b* have a substantially pentagonal shape, but in other embodiments they can have other shapes. Each flange includes an inwardly-projecting tab 311 (i.e., a tab projecting toward the other flange): flange 310*a* includes tab 311*a* and flange 310*b* includes tab 311*b*. Base 312 is coupled to the distal end 122 of rear leg 106. Base 312 and both flanges 310*a* and 310*b* are coupled to a cylindrical sleeve 312 at one end. At or near an end of fitting 124 opposite sleeve 314, rod 133 extends through a pair of aligned holes in flanges 310*a* and 310*b*. Sleeves 135 slide onto rod 133 to allow attachment of cylindrical sleeves 134 of rails 132 to rod 133 (see FIG. 1A).

To connect rear leg 106 to girder 102, fitting 124 is inserted into fitting 114 between flanges 302*a* and 302*b*, so that cylindrical sleeve 314 aligns with hole pair 306—i.e., holes 306*a* and 306*b*. A bolt 316 is inserted into hole 306*a*, through sleeve 314, and out hole 306*b*, where a nut is attached to the end of the bolt and tightened to keep the bolt in place. Once bolt 316 is secured in place, rear leg 106 can rotate about bolt 316 between a deployed position and a folded or stored position. In the deployed position, tabs 311*a* and 311*b* are brought flush with base 304 of fitting 304, at which point hole pair 308 in flanges 302 aligns with a lower surface of rear leg 106. A pin 318 can then be inserted through holes 308*a* and 308*b*, so that the pin is in contact with a lower surface of rear leg 106 and prevents rotation of rear leg 106 about bolt 316, thus locking the front leg in its deployed position (see, e.g., FIGS. 1B-1F). To change exercise bench 100 from its deployed position to its stored or folded position, pin 318 is removed and rear leg 106 is rotated about bolt 316 until rear leg 106 is substantially parallel to girder 102, at which point the rear leg will be in its stored position. Pin 318 is then inserted through holes 308*a* and 308*b*, which are then flush with flanges 310*a*-310*b*, to prevent rotation of rear leg 106 about bolt 316, thus locking the rear leg in its stored or folded position (see, e.g., FIGS. 6A-6C). Hole pair 308, including holes 308*a* and 308*b*, can thus be considered both a "deployment hole" and a "storage hole," since the hole pair is used to lock rear leg 106 in both its deployed and stored positions.

Figure 4A:
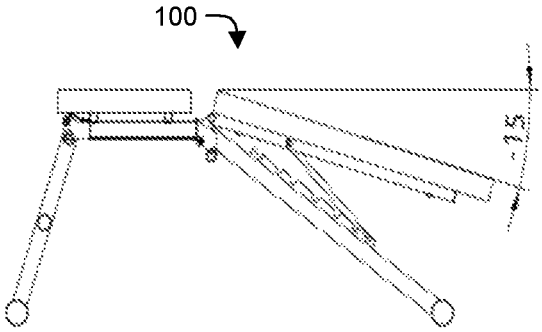
FIGS. 4A-4G are side-views of an embodiment of a foldable exercise bench in its deployed configuration with its backrest positioned at different backrest angles.
Figure 4B:
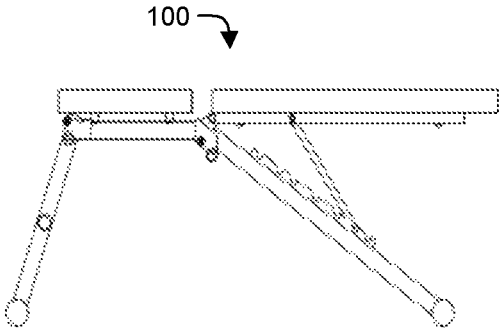
Figure 4C:
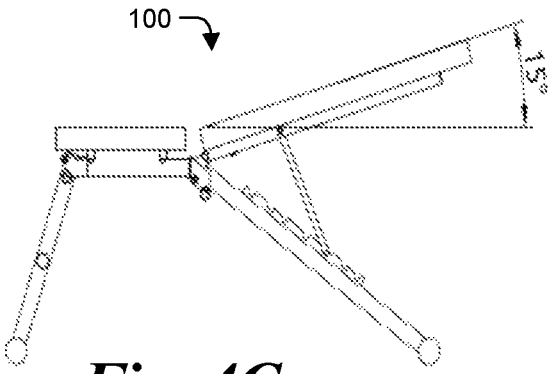
Figure 4D:
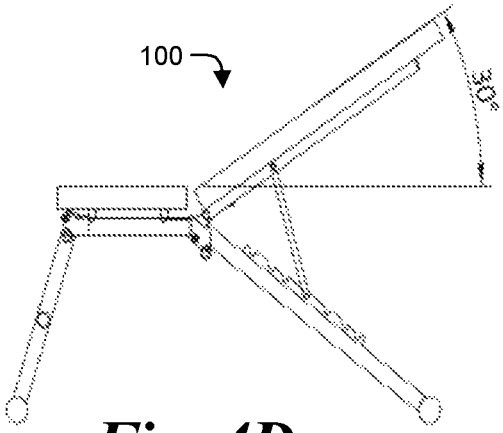
Figure 4E:
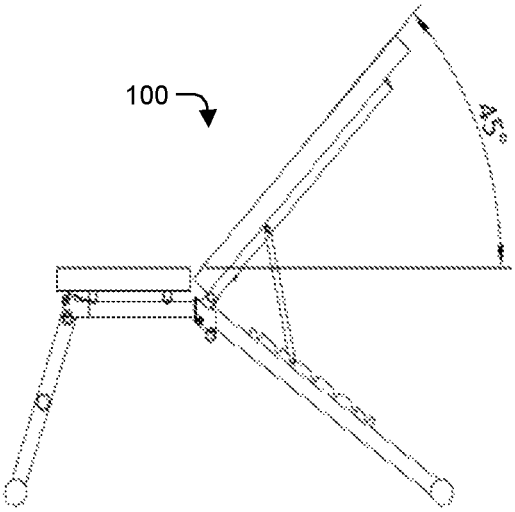
Figure 4F:
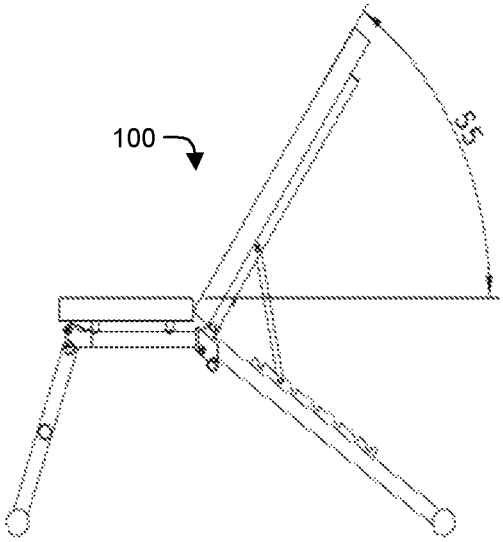
Figure 4G:
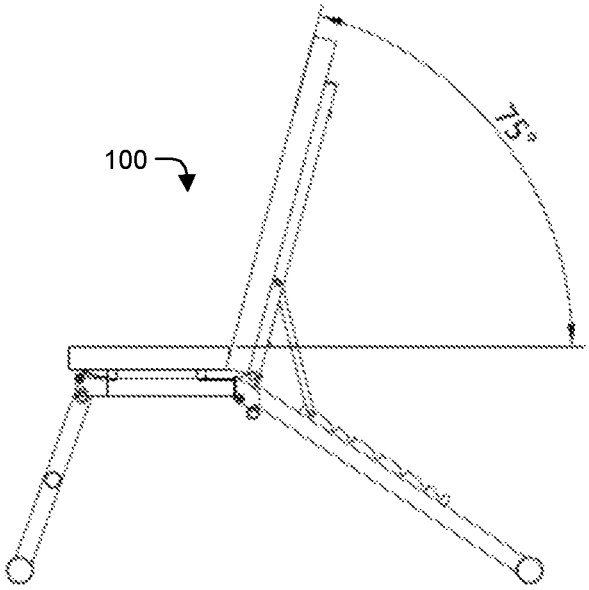

FIGS. 4A-4G illustrate how the backrest angle (the angle of backrest 110 relative to seat 108 or girder 102) can be adjusted in an embodiment of exercise bench 100. As previously explained, rails 132 include sleeves 134 that rotate about rod 133. As a result, the backrest angle is variable. In the illustrated embodiment, the backrest angle can take on values from −15 degrees (FIG. 4A) to +75 degrees (FIG. 4G). The number of discrete backrest angles at which the backrest can be fixed depends largely on the number of detents—i.e., on the number of aligned notch pairs in rails 144. In the illustrated embodiment, the backrest can be fixed at seven different angles: −15 degrees (FIG. 4A), 0 degrees (FIG. 4B), +15 degrees (FIG. 4C), +30 degrees (FIG. 4D), +45 degrees (FIG. 4E), +55 degrees (FIG. 4F) and +75 degrees (FIG. 4G). A particular backrest angle is maintained by inserting transverse portion 140 of positioning strut 136 into the appropriate aligned notch pair in rails 144—that is, in the appropriate detents. Generally, the higher the backrest angle, the closer to girder 102 will be the detent used to receive transverse portion 140. Other embodiments of exercise bench 100 can of course have more or less detents than shown and can have detents positioned to implement different backrest angles than shown.

Figure 5A:
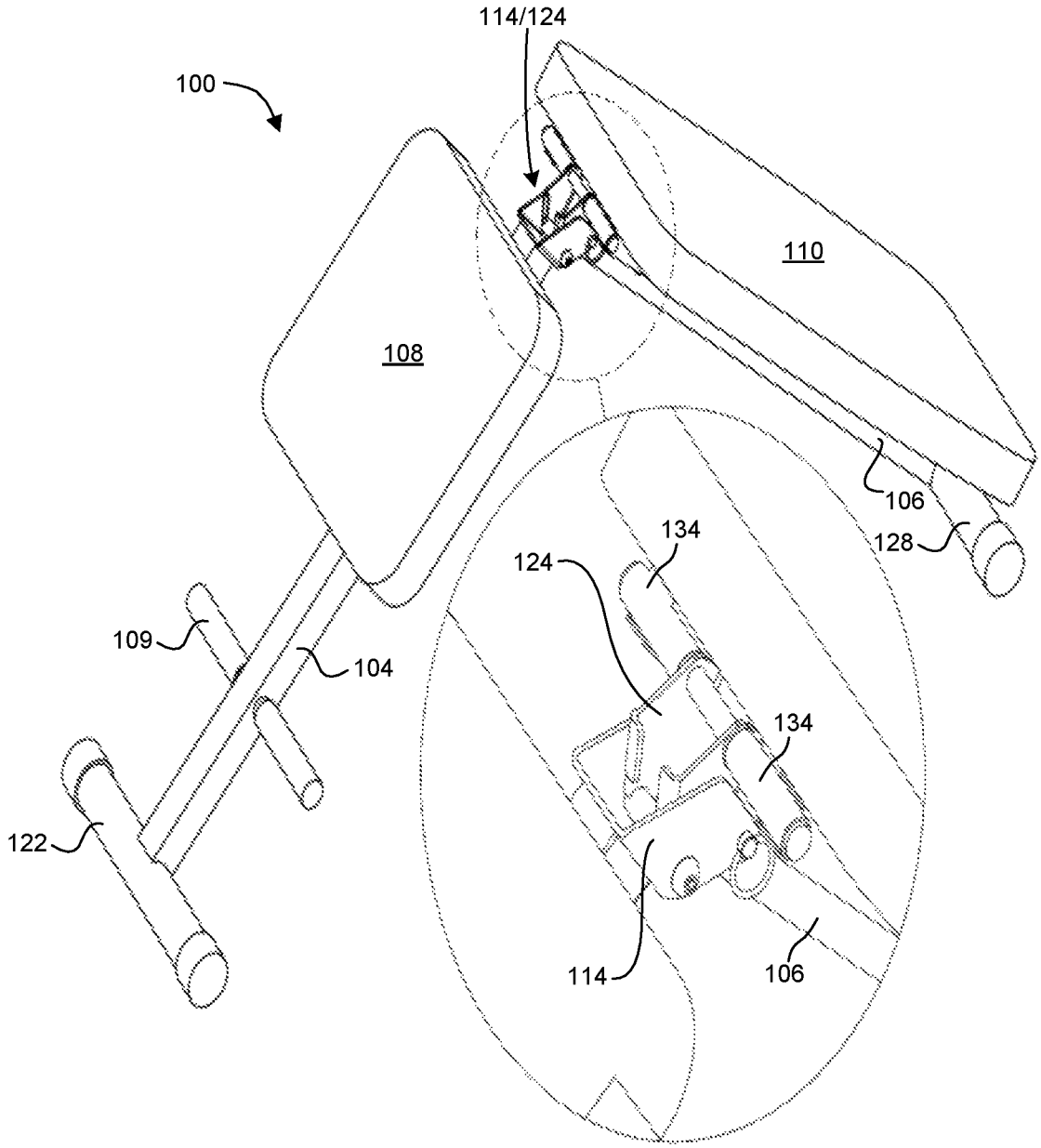
FIGS. 5A-5D together are drawings of an embodiment of a foldable exercise bench during folding and in its folded configuration.
Figure 5B:
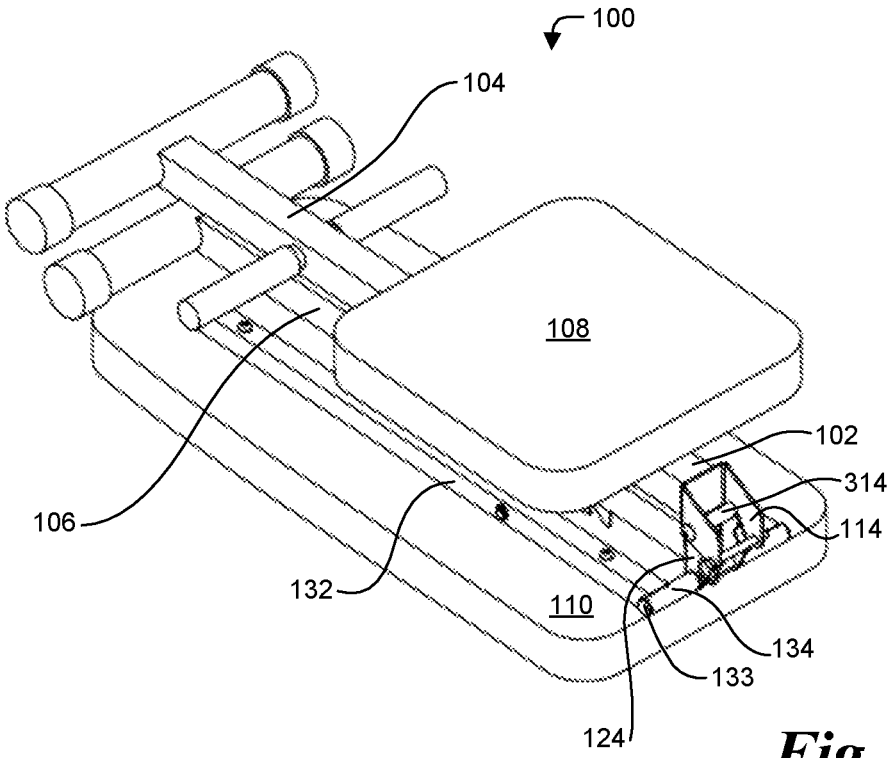
Figure 5C:
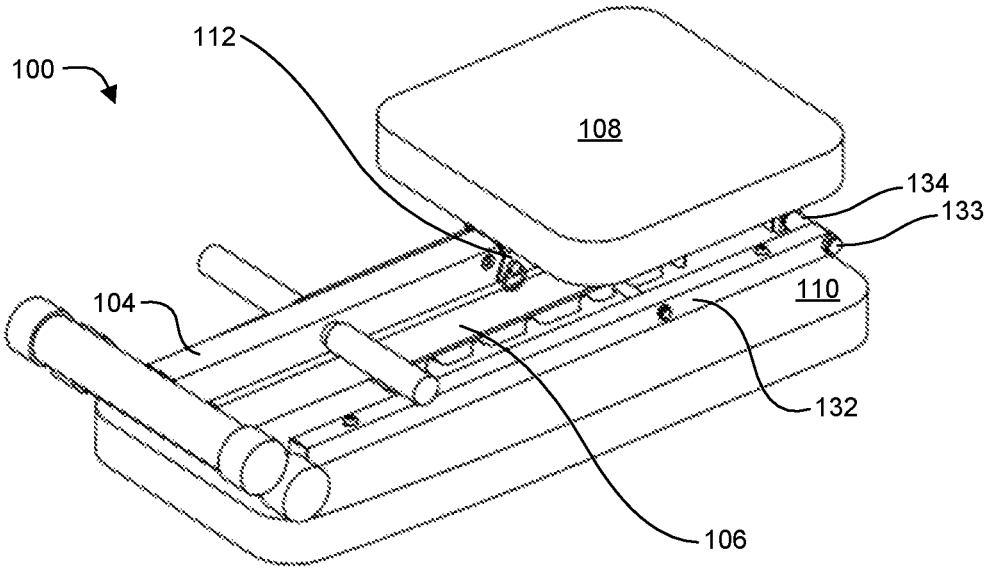
Figure 5D:
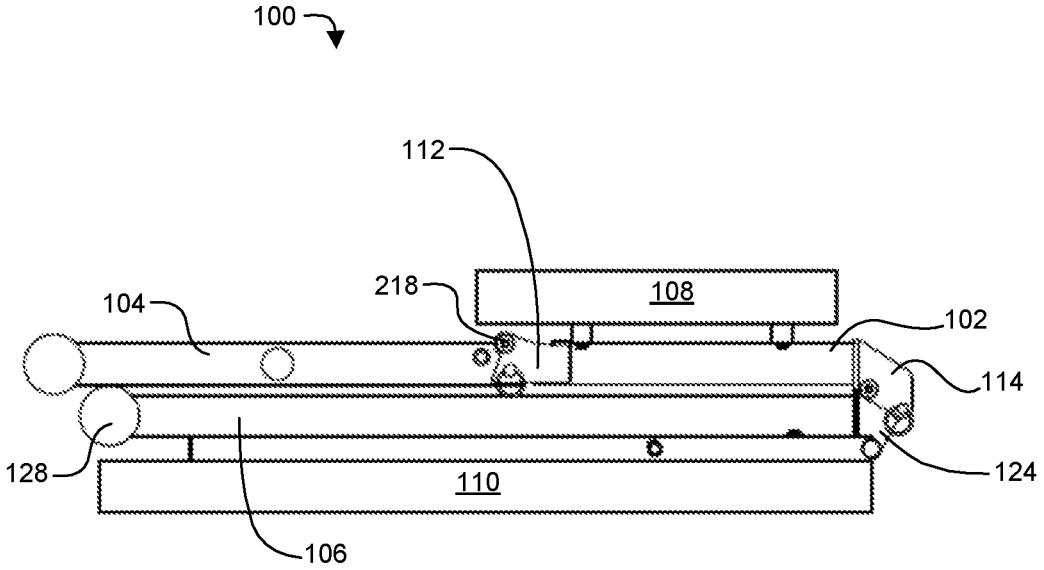

FIGS. 5A-5D together illustrate an embodiment of foldable exercise bench 100 during folding and in its folded or stored configuration. FIG. 5A is a perspective view during folding of rear leg 106, FIGS. 5B-5C are perspective view of the folded configuration, and FIG. 5D is a side view of the folded configuration. In the folded or stored configuration, front leg 104 is rotated about bolt 218 as described above for FIGS. 2A-2B until it is substantially aligned with girder 102. When front leg 104 substantially aligns with the girder, holes 204*a* and 204*b* align with holes 216*a* and 216*b*, respectively. Pin 220 can then be inserted through holes 216*a*, 204*a*, 204*b*, and 216*b* to prevent rotation of front leg 104 about bolt 218, thus locking the front leg in its stored position. In the folded or stored configuration, rear leg 106 is rotated about bolt 316 until its foot 128 is in contact with stored front leg 104, at which point rear leg 106 will be substantially parallel to front leg 104 and girder 102, with a small separation between the rear leg and the front leg and girder. Positioning strut 136 is disengaged from any detents in rails 132, and sleeves 134 rotate about pin 133 so that rails 132 end up on either side of, and substantially parallel to, rear leg 106. The result is a compact folded configuration.

The above description of embodiments is not intended to be exhaustive or to limit the invention to the described forms. Specific embodiments of, and examples for, the invention are described herein for illustrative purposes, but various modifications are possible.

What is claimed is:

1. An exercise bench, comprising:

a girder coupled to a seat, the girder comprising a front end and a rear end, the front end having a first fitting and the rear end having a second fitting;

a front leg having a proximal end and a distal end, the distal end including a foot, and the proximal end being rotatably coupled to the first fitting so that the front leg can rotate about the first fitting between a deployed position and a stored position;

a rear leg having a proximal end and a distal end, the distal end including a foot, and the proximal end being rotatably coupled to the second fitting so that the rear leg can rotate about the second fitting between a deployed position and a stored position;

a pair of backrest rails coupled to a backrest and rotatably coupled to the second fitting; and an angular adjustment mechanism to adjust an angle of the backrest relative to the seat, wherein the front leg rotates about a bolt that extends through the first fitting and through a cylindrical collar at or near the proximal end of the front leg, and wherein the front leg is held in its storage position by a pin inserted in a hole in the first fitting and through a storage hole near the proximal end of the front leg.

2. The exercise bench of claim 1, wherein the front leg can rotate about the first fitting between a deployed position at a non-zero angle relative to the girder and a stored position substantially parallel to the girder.

3. The exercise bench of claim 2, wherein the rear leg can rotate about the second fitting between a deployed position at a non-zero angle relative to the girder and a stored position substantially parallel to the girder.

4. The exercise bench of claim 3, wherein the front leg and the rear leg occupy their stored positions simultaneously, so that the exercise bench is substantially flat in the stored position.

5. The exercise bench of claim 1, wherein the angular adjustment mechanism comprises a positioning strut rotatably coupled to at least one backrest rail of the pair of backrest rails, wherein the positioning strut can extend from the at least one backrest rail to one of a plurality of detents on the rear leg to maintain the backrest at an angle relative to the girder.

6. The exercise bench of claim 5, wherein the plurality of detents allows the backrest to be positioned at angles between −15 degrees and +75 degrees relative to the girder.

7. The exercise bench of claim 1, wherein the front leg is held in its deployed position by a pin inserted in a hole in the first fitting and through a deployment hole near the proximal end of the front leg.

8. The exercise bench of claim 1, wherein the rear leg rotates about a bolt that extends through the second fitting and through the proximal end of the rear leg.

9. The exercise bench of claim 8, wherein the rear leg is held in its deployed position by a pin inserted in a deployment hole that extends through the second fitting and is in contact with the rear leg.

10. The exercise bench of claim 8, wherein the rear leg is held in its stored position by a pin that is inserted in a storage hole in the second fitting and is in contact with the rear leg.

11. The exercise bench of claim 1, wherein the first fitting comprises:

a base coupled to the front end of the girder, the base including a surface against which a surface of the front leg will be flush when the front leg is in its deployed position;

a pair of spaced-apart flanges coupled to the base;

first and second aligned hole pairs, wherein each the first hole pair includes one hole in each flange and the second hole pair includes one hole in each flange.

12. The exercise bench of claim 11, wherein the first aligned hole pair is adapted to receive a bolt about which the front leg can rotate and the second aligned hole pair is adapted to receive a pin to lock the front leg in its deployed position or its stored position.

13. The exercise bench of claim 1, wherein the seat is coupled to the girder by a pair of seat rails.

14. The exercise bench of claim 1, wherein the foot of the front leg extends substantially perpendicular to the front leg and the foot of the rear leg extends substantially perpendicular to the rear leg.

15. An exercise bench, comprising:

a girder coupled to a seat, the girder comprising a front end and a rear end, the front end having a first fitting and the rear end having a second fitting;

a front leg having a proximal end and a distal end, the distal end including a foot, and the proximal end being rotatably coupled to the first fitting so that the front leg can rotate about the first fitting between a deployed position and a stored position;

a rear leg having a proximal end and a distal end, the distal end including a foot, and the proximal end being rotatably coupled to the second fitting so that the rear leg can rotate about the second fitting between a deployed position and a stored position;

a pair of backrest rails coupled to a backrest and rotatably coupled to the second fitting; and an angular adjustment mechanism to adjust an angle of the backrest relative to the seat, wherein the first fitting comprises:

a base coupled to the front end of the girder, the base including a surface against which a surface of the front leg will be flush when the front leg is in its deployed position;

a pair of spaced-apart flanges coupled to the base;

first and second aligned hole pairs, wherein each the first hole pair includes one hole in each flange and the second hole pair includes one hole in each flange, and wherein the second fitting comprises a first part, the first part comprising:

a base coupled to the rear end of the girder;

a pair of spaced-apart flanges coupled to the base; and first and second aligned hole pairs, wherein each the first hole pair includes one hole in each flange and the second hole pair includes one hole in each flange.

16. The exercise bench of claim 15, wherein the first aligned hole pair is adapted to receive a bolt about which the front leg can rotate and the second aligned hole pair is adapted to receive a pin to lock the front leg in its deployed position or its stored position.

17. The exercise bench of claim 15, wherein the second fitting further comprises a second part, the second part comprising:

a base coupled to the proximal end of the rear leg, a pair of spaced-apart flanges coupled to the base, and first and second aligned hole pairs, wherein each the first hole pair includes one hole in each flange and the second hole pair includes one hole in each flange.

18. The exercise bench of claim 17, wherein the first aligned hole pair is adapted to receive a bolt about which the rear leg can rotate and the second aligned hole pair is adapted to receive a rod about which the backrest can rotate.

19. The exercise bench of claim 17, wherein the second part further comprises an inwardly-projecting tab coupled to each flange, so that the inwardly-projecting tabs are in contact with the base of the first part when the rear leg is in the deployed position.

20. The exercise bench of claim 15, wherein the front leg can rotate about the first fitting between a deployed position at a non-zero angle relative to the girder and a stored position substantially parallel to the girder.

21. The exercise bench of claim 20, wherein the rear leg can rotate about the second fitting between a deployed position at a non-zero angle relative to the girder and a stored position substantially parallel to the girder.

* * * * *